US011939710B2

(12) United States Patent
Lonati et al.

(10) Patent No.: US 11,939,710 B2
(45) Date of Patent: Mar. 26, 2024

(54) DEVICE FOR FEEDING YARN OR YARNS FOR KNITTING MACHINES FOR HOSIERY OR THE LIKE

(71) Applicant: LONATI S.P.A., Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 16/614,520

(22) PCT Filed: May 25, 2018

(86) PCT No.: PCT/EP2018/063784
§ 371 (c)(1),
(2) Date: Nov. 18, 2019

(87) PCT Pub. No.: WO2018/219806
PCT Pub. Date: Dec. 6, 2018

(65) Prior Publication Data

US 2020/0181817 A1 Jun. 11, 2020

(30) Foreign Application Priority Data

May 29, 2017 (IT) ..... 102017000057890

(51) Int. Cl.
*D04B 15/58* (2006.01)

(52) U.S. Cl.
CPC ..... *D04B 15/58* (2013.01); *D10B 2501/021* (2013.01)

(58) Field of Classification Search
CPC ..... D04B 15/38; D04B 15/54; D04B 15/58; D04B 15/80; D04B 15/99; D04B 27/10; D04B 27/24
(Continued)

(56) References Cited

U.S. PATENT DOCUMENTS 3,500,663 A * 3/1970 Richard ..... D04B 15/58 66/139
3,864,942 A * 2/1975 Savage ..... D04B 15/78 66/221
(Continued)

FOREIGN PATENT DOCUMENTS

CN 108374232 8/2018
DE 3104816 12/1981
(Continued)

OTHER PUBLICATIONS

English language translation of the examination report from corresponding Eurasian patent application 201992763/31, dated Aug. 1, 2020.
(Continued)

*Primary Examiner* — Aiying Zhao
(74) *Attorney, Agent, or Firm* — Quicker Law, LLC

(57) ABSTRACT

A device for feeding yarn or yarns for knitting machines for hosiery or the like, comprising a supporting structure which supports at least one yarn finger having an elongated shape and being pivoted, at an intermediate portion thereof, to the supporting structure about a corresponding rotation axis and having, proximate to a longitudinal end thereof, a passage for the yarn or yarns to be fed to the needles of the knitting forming machine, the device for feeding yarn or yarns comprising an electromagnetically actuated device which comprises at least one magnet which is fixed to the at least one yarn finger and at least one electric coil which is laterally adjacent to the at least one yarn finger and is connected to the supporting structure.

14 Claims, 7 Drawing Sheets

(58) Field of Classification Search
USPC ..... 66/125 R, 136 A, 219
See application file for complete search history.

(56) References Cited

U.S. PATENT DOCUMENTS

| | | | | | |
|---|---|---|---|---|---|
| 3,928,988 | A * | 12/1975 | Luth | D04B 15/58 | 66/138 |
| 4,195,277 | A * | 3/1980 | Leicht | B41J 9/38 | 335/229 |
| 4,998,420 | A * | 3/1991 | Scavino | D04B 15/58 | 66/138 |
| 5,251,463 | A * | 10/1993 | Lonati | D04B 15/58 | 66/140 R |
| 5,691,965 | A * | 11/1997 | Jansen | G06K 7/10643 | 369/44.11 |
| 5,983,677 | A * | 11/1999 | Shibata | D04B 15/78 | 66/216 |
| 7,310,977 | B2 * | 12/2007 | Ueyama | D04B 15/78 | 66/219 |
| 2009/0139272 | A1 * | 6/2009 | Lonati | D04B 15/78 | 66/219 |

FOREIGN PATENT DOCUMENTS

| | | | |
|---|---|---|---|
| DE | 3104816 | A1 | 12/1981 |
| EP | 0056619 | | 7/1982 |
| EP | 0056619 | A2 | 7/1982 |
| EP | 0972869 | | 1/2000 |
| GB | 1005095 | | 9/1965 |
| GB | 2012316 | | 7/1979 |
| GB | 2012316 | A | 7/1979 |
| JP | S63-114558 | A | 5/1988 |
| JP | 02-033359 | A | 2/1990 |
| JP | 2001-188277 | A | 7/2001 |
| JP | 2014-132803 | A | 7/2017 |
| NC | 2017/0007855 | | 2/2017 |
| WO | 96/11484 | | 4/1996 |
| WO | 9611484 | A2 | 4/1996 |
| WO | 02097177 | | 12/2002 |

OTHER PUBLICATIONS

Examination report from corresponding Pakistan patent application 373/2018, dated Aug. 19, 2020.

International Search Report regarding PCT/EP2018/063784, dated Jul. 25, 2018 (4 pgs.).

Written Opinion of the International Searching Authority regarding PCT/EP2018/063784, dated Jul. 25, 2018 (6 pgs.).

Ministero dello Sviluppo Economico Search Report regarding priority document IT 201700057890, dated Feb. 13, 2018 (2 pgs.).

Written Opinion of the Ministero dello Sviluppo Economico regarding priority document IT 201700057890, in Italian, dated Feb. 13, 2018 (6 pgs.).

Pakistan First Office Action of Pakistan Application No. 373/2018, dated Feb. 10, 2020.

Examination report from corresponding EP patent application 18 725 257.2, dated Apr. 14, 2021.

English Translation of the Preliminary Office Action Report issued for Brazilian Patent Application No. BR112019017307-2 dated May 3, 2022.

Decision of Refusal issued for Japanese Patent Application No. 2019-554964 dated Apr. 13, 2022.

Examination Report for India Patent Application No. 201937054092 dated Dec. 14, 2021.

Examination Report for Egyptian Patent Application No. 2012020184 dated Jan. 5, 2022.

Second Office Action from related CN patent application 201880035941.5, dated Jul. 2, 2021.

English-language translation of Second Office Action from related CN patent application 201880035941.5, dated Jul. 2, 2021.

Examination Report for Egyptian Patent Application No. 2019111833, dated Jul. 20, 2022, 10 pages, Egyptian Patent Office.

Notice of Final Rejection for Korean Patent Application No. 10-2019-7035505, dated Aug. 25, 2022, 8 pages, South Korean Intellectual Property Office.

Notice of Allowance issued by the Ukrainian Institute of Intellectual Property for Ukraine Application No. 2019 11303 dated Aug. 25, 2021.

English translation of Notice of Reasons for Refusal issued for Japanese Patent Application No. 2019-554964 dated Sep. 22, 2021.

English translation of Notification of Reason for Refusal issued for Korean Patent Application No. 10-2019-7035505 dated Aug. 5, 2021.

Office Action dated Sep. 14, 2023 in HN 2019002915 with partial English-language translation (8 pgs.).

Office Action dated Oct. 24, 2023 in JP 2019-554964 with partial English-language translation (13 pgs.).

* cited by examiner

DEVICE FOR FEEDING YARN OR YARNS FOR KNITTING MACHINES FOR HOSIERY OR THE LIKE

The present invention relates to a device for feeding yarn or yarns for knitting machines for hosiery or the like, particularly for circular knitting machines for hosiery or the like.

As is known, in knitting machines for hosiery or the like, in order to provide the needles with the yarn, which constitutes the raw material for the production of knitted manufacturers, devices for feeding the yarn or yarns are used which are composed of adapted elements, known as yarn fingers, which are arranged proximate to a feed or drop of the machine at which the needles are actuated to take up the yarn or yarns and form new loops of knitting, knocking off the previously formed loops of knitting.

The function of the yarn fingers is to place the yarn or yarns in a position that is suitable to be engaged by the needles that are moved to knit at the feed being considered.

In single-cylinder circular machines, generally, the needle cylinder, which has a vertical axis, is rotated about its own axis with respect to the yarn fingers which are mounted on adapted supports which are fixed to the supporting structure of the machine. Directly upstream of a feed or drop of the machine, the needles that must form knitting at the feed being considered are raised so as to take up the yarn or yarns fed to them by one or more yarn fingers and are then lowered so as to form new loops of knitting with the yarn or yarns that they have engaged.

In order to allow to produce knitting with different yarns, for example of mutually different color or type, at a same feed or drop there is generally a yarn feeder, composed of multiple yarn fingers arranged mutually adjacent, each of which supports one type of yarn.

Generally, each yarn finger has an elongated shape and, at one of its longitudinal ends, which is directed toward the needle cylinder, it has a passage, usually formed by a small tube, through which the yarn to be fed to the needles is made to pass.

In general, each yarn finger can move in at least two positions: an inactive position, in which its yarn dispensing end is spaced from the needle work area so that they cannot take up the yarn dispensed by this yarn finger, to an active position, in which its yarn dispensing end is closer to the needle cylinder so as to allow the needles, which are moved to knit at the feed being considered, to take up the yarn that is dispensed by the yarn finger.

For some kinds of knitting, for example in plated knitting, one yarn finger is required to be arranged in an intermediate position in order to allow the needles to pick up two yarns at different heights so that they arrange themselves in the head of the needles in precise positions so as to have one yarn visible on the plain side of the manufacture and the other yarn visible on the reverse side of the manufacture, indeed creating the plated effect. In this case, at least some of the yarn fingers of the yarn feeder must be arrangeable in two active positions: a first active position, which corresponds to the active position defined previously, and a second active position or intermediate position, also known as "plated position".

Generally, the yarn feeders currently used in single-cylinder circular knitting machines for hosiery or the like are composed of a plurality of yarn fingers, each having an elongated shape, pivoted with an intermediate portion thereof to a supporting structure about a rotation axis which is usually common to all the yarn fingers.

The transition of the various yarn fingers from the inactive position to the active position or to the active positions is achieved by means of mechanical or pneumatic or electromagnetic actuators.

Mechanical actuators, generally constituted by lever systems or cams, while providing high precision in operation, have the drawback of being complicated to manufacture and assemble.

Pneumatic actuators, while offering very simple assembly, have the drawback of constantly requiring the availability of a compressed air distribution network.

In order to solve these problems, yarn fingers have been provided which are actuated electromagnetically by winding electric coils on a portion of each yarn finger and by arranging magnets to the side of the yarn fingers so that the individual electric power supply of the coils, immersed in the magnetic field generated by the magnets, causes the individual rotation of the yarn fingers about the corresponding rotation axis with respect to the supporting structure in order to pass from the inactive position to the first active position. In these yarn fingers, the intermediate position or second active position is obtained by means of a mechanical stop element which limits the rotation of the corresponding yarn finger.

In these yarn fingers, while offering greater practicality in use and high precision in operation, fatigue failure of the cables that connect the coils arranged on the yarn fingers to the electric power supply is often observed due to the continuous deformations caused by the movement of the yarn fingers.

The aim of the present invention is to solve the problems described above, providing a device for feeding yarn or yarns for knitting machines for hosiery or the like that maintains the advantages, in terms of precision and repeatability, that are typical of electromagnetic actuation and at the same time ensures high durability and reliability without requiring frequent maintenance interventions.

Within this aim, an object of the invention is to provide a device that can have a space occupation that does not cause problems during installation on the knitting machine for hosiery or the like.

Another object of the invention is to provide a device that can be managed and controlled electronically.

A further object of the invention is to propose a device that can be manufactured with competitive costs.

This aim, as well as these and other objects which will become better apparent hereinafter, are achieved by a device for feeding yarn or yarns for knitting machines for hosiery or the like, comprising a supporting structure which supports at least one yarn finger which has an elongated shape and is pivoted, at an intermediate portion thereof, to said supporting structure about a corresponding rotation axis and having, proximate to a longitudinal end thereof, a passage for the yarn or yarns to be fed to the needles of the knitting forming machine, an electromagnetically actuated device being provided which acts on command on said at least one yarn finger for its rotation, with respect to said supporting structure, about the corresponding rotation axis, from an inactive position to at least one active position, which is angularly spaced with respect to said inactive position about said rotation axis, or vice versa, characterized in that said electromagnetically actuated device comprises at least one magnet which is fixed to said at least one yarn finger and at least one electric coil which is laterally adjacent to said at least one yarn finger and is connected to said supporting structure, said at least one electric coil being able to be supplied electrically to generate a magnetic field that interacts with said at least one magnet to actuate the rotation of said at least one yarn finger about the corresponding rotation axis with respect to said supporting structure.

Further characteristics and advantages of the invention will become better apparent from the description of a preferred but not exclusive embodiment of the device for feeding yarn or yarns according to the invention, illustrated by way of nonlimiting example in the accompanying drawings, wherein.

Figure 1:
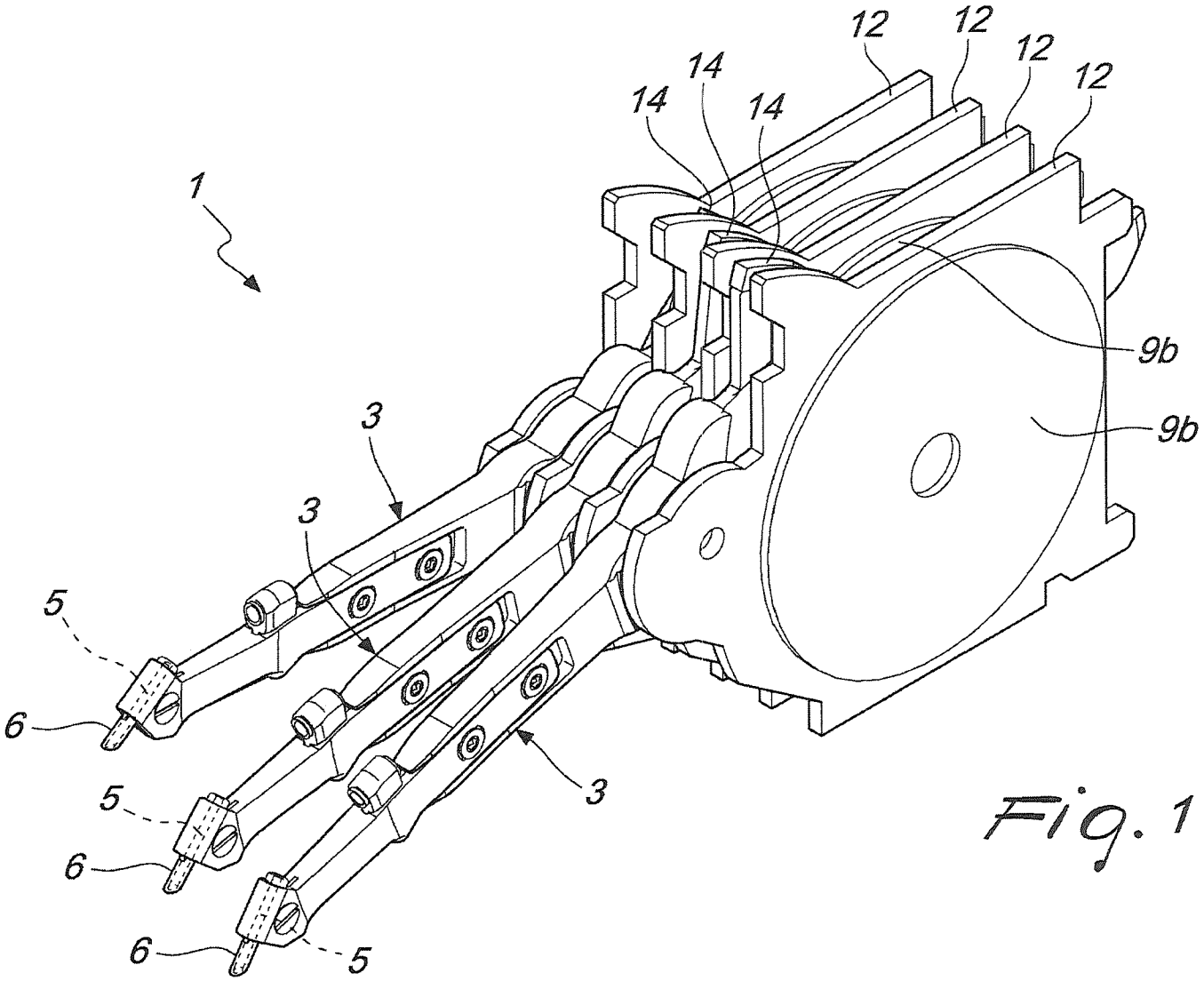
FIG. 1 is a perspective view of a device for feeding yarn or yarns according to the invention, showing only three yarn fingers, shown in three different operating positions.
Figure 2:
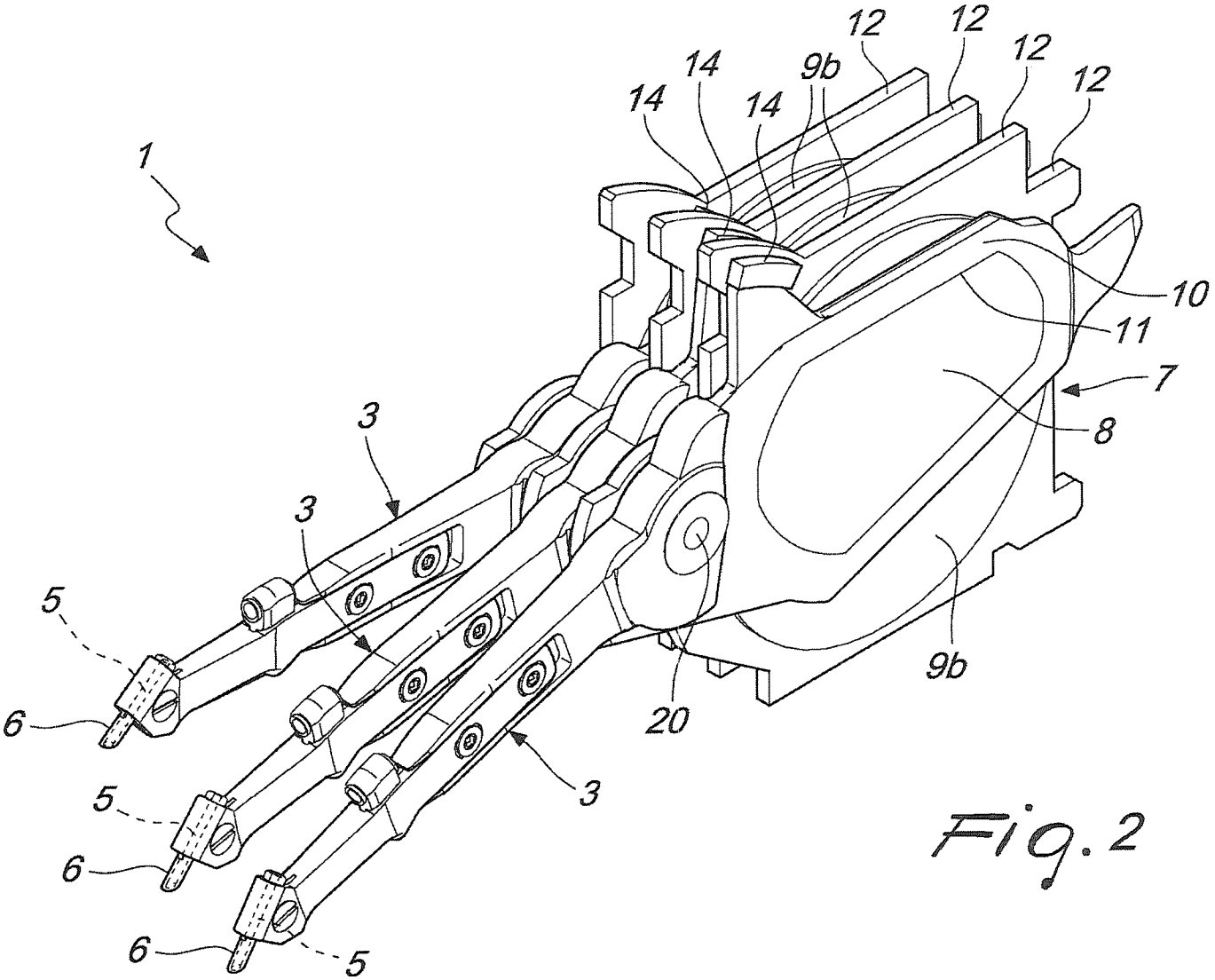
FIG. 2 is a view of the device of FIG. 1, with a part removed in order to better illustrate the components of the yarn finger assembly.
Figure 3:
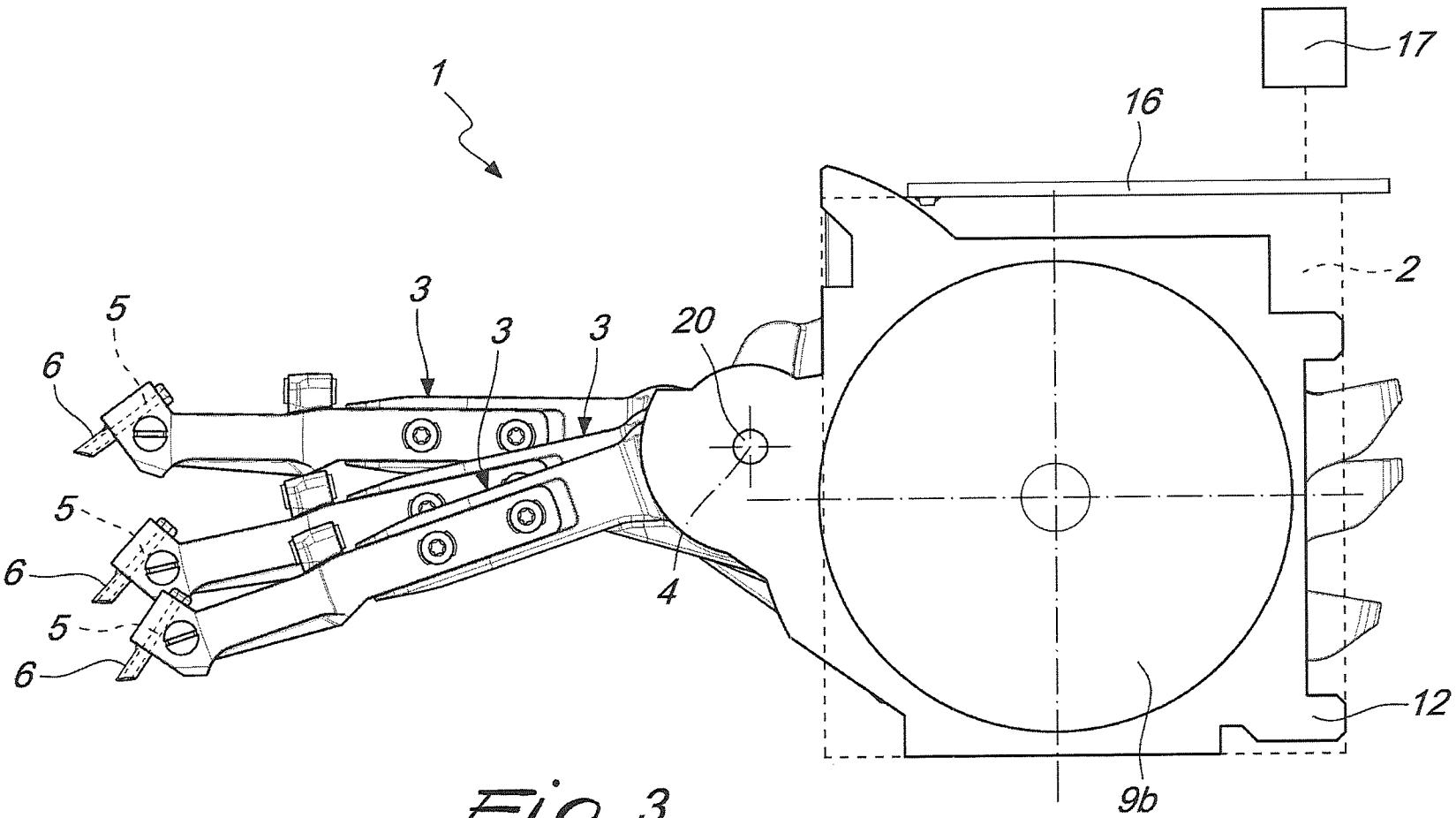
FIG. 3 is a lateral elevation view of the device according to the preceding figures.
Figure 4:
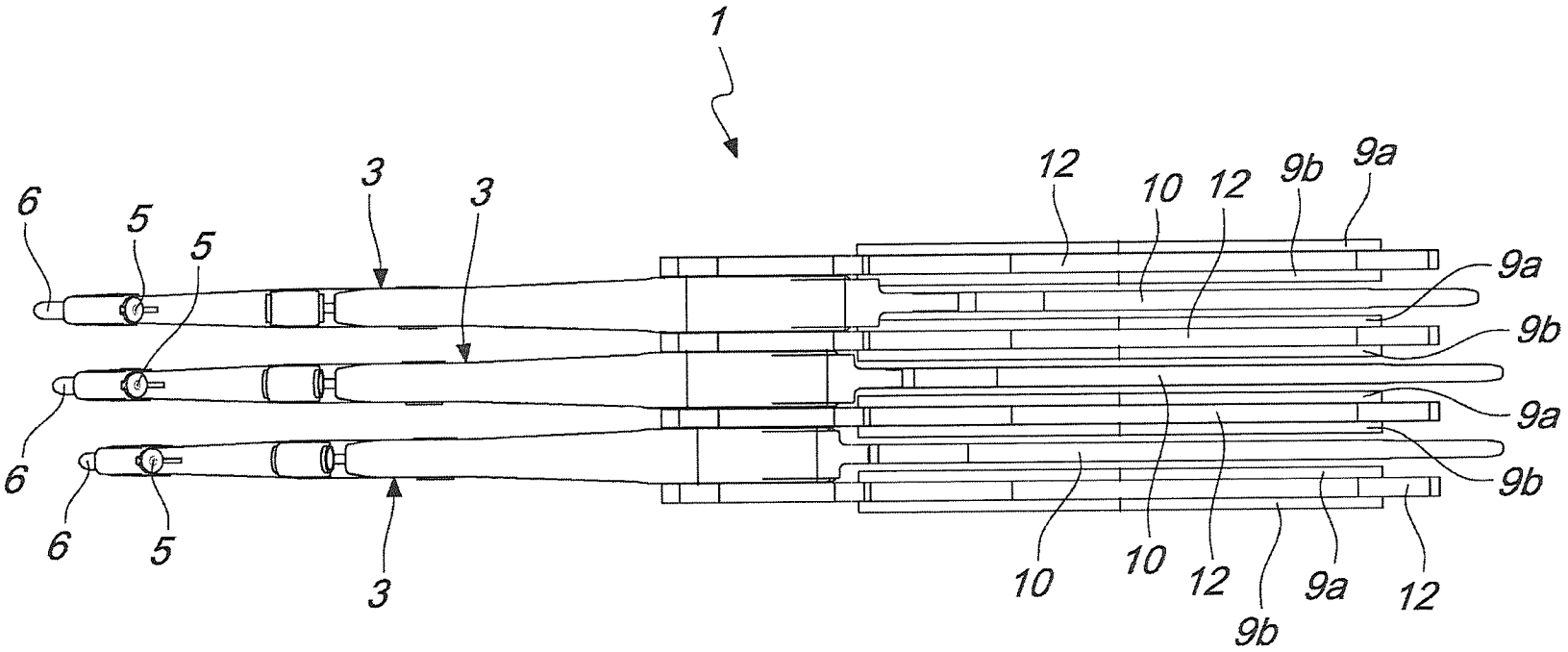
FIG. 4 is a top plan view of the device of FIGS. 1 to 3.
Figure 5:
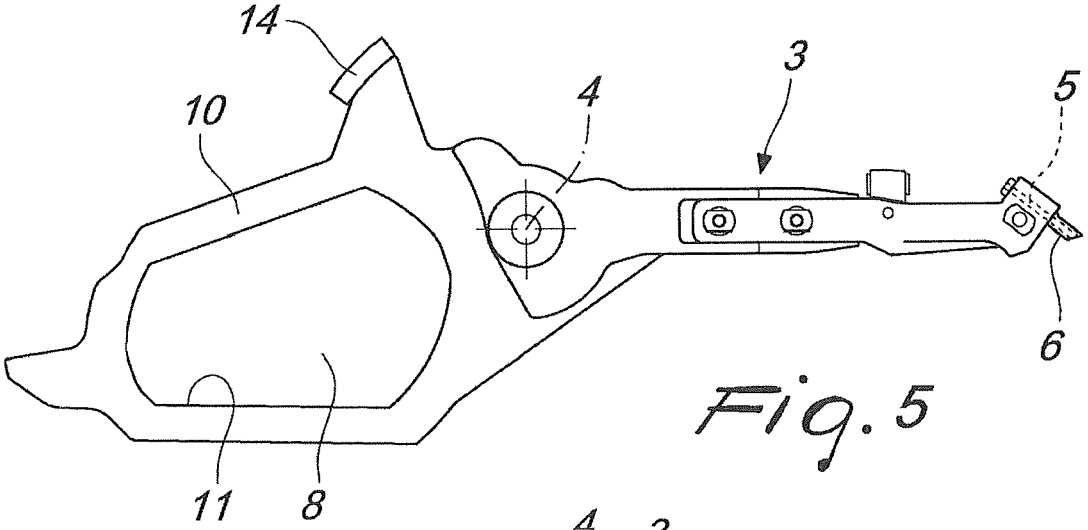
FIG. 5 is a lateral elevation view of a yarn finger.
Figure 6:
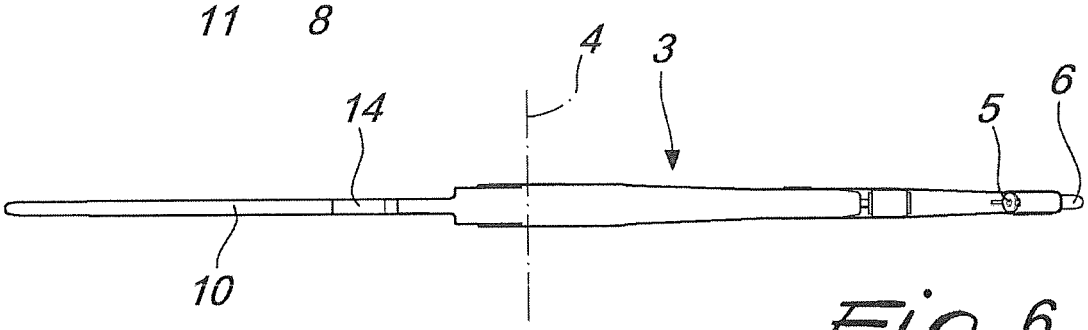
FIG. 6 is a top plan view of the yarn finger of FIG. 5.
Figure 7:
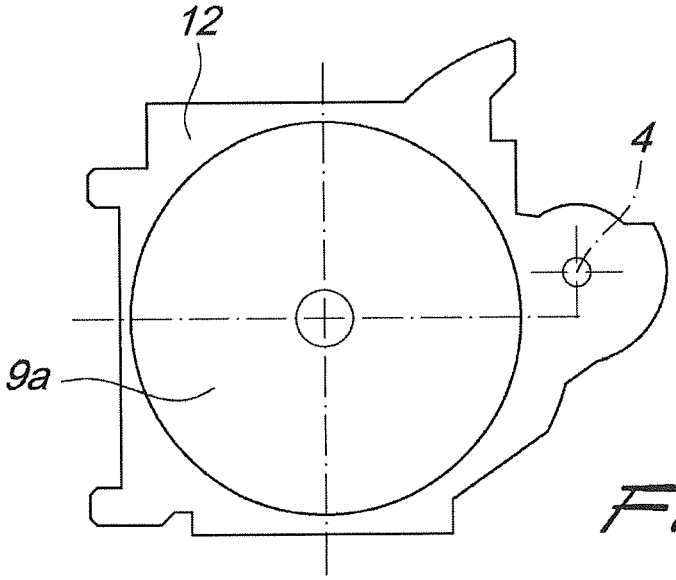
FIG. 7 is a lateral elevation view of a component of the device according to the invention.
Figure 8:
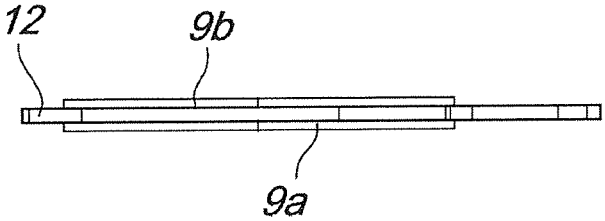
FIG. 8 is a top plan view of the component of FIG. 7.

With reference to the cited figures, the device for feeding yarn or yarns according to the invention, designated generally by the reference numeral 1, comprises a supporting structure 2, shown schematically and in dashed lines only in FIG. 3, which is designed to be fixed to the supporting structure of a knitting machine for hosiery or the like, at a feed or drop of the machine. The supporting structure 2 supports at least one yarn finger 3, which has an elongated shape and is pivoted, at an intermediate portion thereof, to the supporting structure 2 about a corresponding rotation axis 4.

In the illustrated embodiment, the device for feeding yarn or yarns according to the invention is composed of three yarn fingers 3 arranged side by side, but the number of yarn fingers 3 may vary according to the requirements. In particular, the device for feeding yarn or yarns according to the invention can comprise even just a single yarn finger 3.

Each yarn finger 3 has, proximate to one of its longitudinal ends, a passage 5 for the yarn or yarns to be fed to the needles of the knitting forming machine. As in yarn fingers of the known type, this passage 5 for the yarn can be defined within a tube 6 which is fixed to the longitudinal end of the yarn finger 3 designed to be directed toward the needle holder, which is constituted by the needle cylinder in circular knitting machines for hosiery or the like.

The device for feeding yarn or yarns according to the invention comprises an electromagnetically actuated device 7 which acts on command on each yarn finger 3 in order to cause its rotation with respect to the supporting structure 2 about the corresponding rotation axis 4, so as to obtain the transition of the corresponding yarn finger 3 from an inactive position, in which the longitudinal end of the yarn finger 3 provided with the tube 6 is in a position that is spaced from the work region of the needles of the machine in order to prevent the pickup of the yarn, dispensed through the tube 6, on the part of the needles that are moved to knit at the feed or drop being considered, to at least one active position, which is angularly spaced from the inactive position about the rotation axis 4, in which the longitudinal end of the yarn finger 3 provided with the tube 6 is in a position that is closer to the needle work region of the machine in order to allow the pickup of the yarn, dispensed through the tube 6, on the part of the needles that are moved to knit at the feed or drop being considered.

According to the invention, the electromagnetically actuated device 7 comprises at least one magnet 8 which is fixed to each yarn finger 3 and at least one electric coil 9*a*, 9*b*, which is laterally adjacent to each yarn finger 3 and is connected to the supporting structure 2. As shown in the figures, the electric coil or coils 9*a*, 9*b* are laterally adjacent to each yarn finger 3 along a direction that is parallel to the rotation axis 4. The at least one electric coil 9*a*, 9*b* can be supplied with electric power in order to generate a magnetic field, which interacts with the magnet 8, so as to cause the rotation of the corresponding yarn finger 3 about the corresponding rotation axis 4 with respect to the supporting structure 2 in order to produce its transition from the inactive position to the at least one active position or vice versa.

Preferably, the yarn fingers 3 are pivoted to the supporting structure 2 about a same rotation axis 4, being mounted on the same shaft which defines, with its axis, said rotation axis 4.

Without altering the fact that multiple magnets can be arranged on the same yarn finger 3, depending on the actuation requirements of said yarn finger 3, in the illustrated embodiment there is a single magnet 8 for each yarn finger 3. Said magnet 8 is fixed to the portion 10 of the corresponding yarn finger 3 that is arranged on the opposite side with respect to the passage 5 for the yarn or yarns, i.e., opposite with respect to the tube 6, relative to the rotation axis 4 of the yarn finger 3.

Conveniently, the portion 10 of the yarn finger 3 that supports the magnet 8 is substantially plate-like and is crossed by a seat 11 which accommodates the corresponding magnet 8. Said portion 10 of the yarn finger 3 is preferably made of molded synthetic material.

Preferably, for each yarn finger 3 a corresponding pair of electric coils 9*a*, 9*b* is provided, wherein each pair of coils is composed of two electric coils 9*a*, 9*b* which face the two opposite faces of the portion 10 of the corresponding yarn finger 3 that supports the magnet 8.

The two electric coils 9*a*, 9*b* of each pair of electric coils are arranged with their axis at right angles to the opposite faces of the portion 10, which is plate-shaped, of the corresponding yarn finger 3 that supports the magnet 8.

In the illustrated embodiment, the two electric coils 9*a*, 9*b* of each pair of coils are coaxial. In particular, the various electric coils 9*a*, 9*b* of the device for feeding yarn or yarns according to the invention are all coaxial.

Conveniently, if the device for feeding yarn or yarns comprises at least two yarn fingers 3 arranged side by side, elements for shielding the magnetic field are provided and are interposed between the two electric coils 9*a*, 9*b*, which belong to two pairs of mutually different electric coils, which act on the magnets 8 of two contiguous yarn fingers 3 so that the actuation of one yarn finger 3, actuated by means of the electric power supply of a pair of electric coils 9*a*, 9*b*, does not interfere with or does not disturb the actuation of a contiguous yarn finger 3.

The shielding elements are preferably constituted by plates 12 made of ferromagnetic material which are arranged at right angles to the rotation axis 4 of the yarn fingers 3 and are connected to the supporting structure 2.

Advantageously, the electric coils 9*a*, 9*b* that act on the magnets of two contiguous yarn fingers 3 are connected to the two opposite faces of a same plate 12 that constitutes one of the shielding elements.

In this manner, the advantage is achieved of simplifying the assembly of the device for feeding yarn or yarns according to the invention and of keeping its overall dimensions small in a direction that is parallel to the rotation axis 4, thus making easier its placement on the machine both during design and during assembly.

Conveniently, each one of the electric coils 9*a*, 9*b* is constituted by one or more wires made of electrically conducting material wound spirally around the axis of the electric coil 9*a*, 9*b* and applied to one face of the plate 12 that constitutes one of the shielding elements. This configuration and arrangement of the electric coils 9*a*, 9*b* also allows to contain the dimensions of the device for feeding yarn or yarns according to the invention in a direction that is parallel to the rotation axis 4.

Preferably, at least one of the yarn fingers 3 can rotate on command about the corresponding rotation axis 4 with respect to the supporting structure 2 from the inactive position to at least one first active position and to at least one second active position, which is arranged between the inactive position and the first active position or vice versa.

Figure 9:
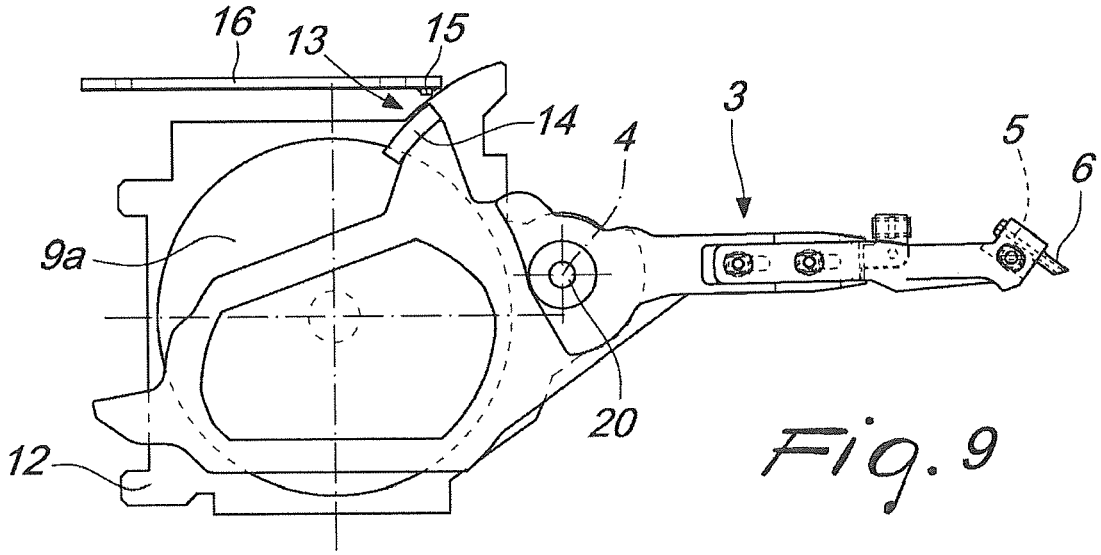
FIGS. 9 to 11 are lateral elevation views, with some components removed, of the device according to the invention, highlighting the different operating positions of a yarn finger.
Figure 10:
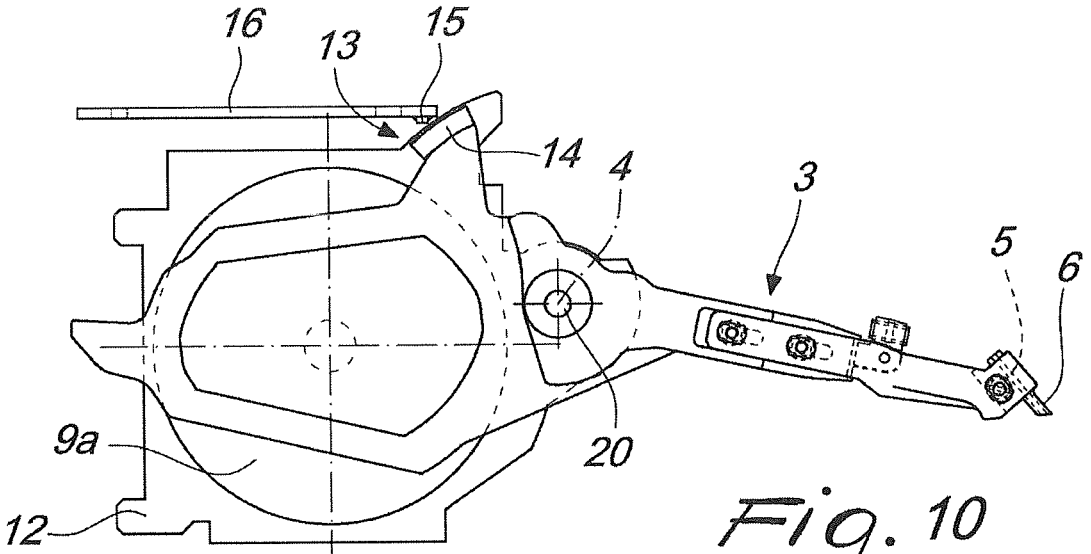
Figure 11:
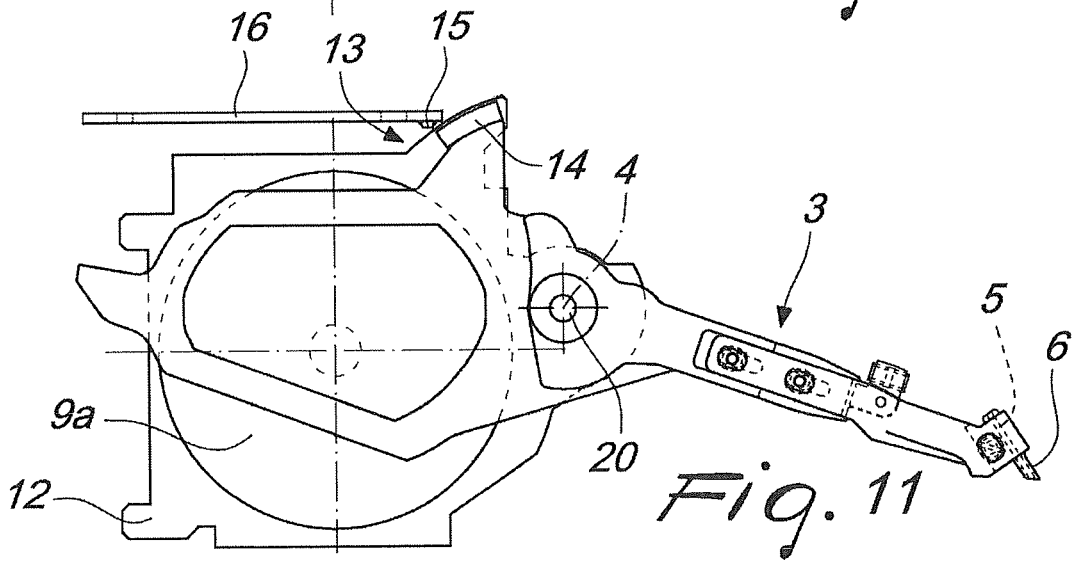

In the accompanying figures, which show the device for feeding yarn or yarns according to the invention as a whole, the three yarn fingers 3 that are shown are each arranged in one of these three positions. In particular, in FIG. 3, the yarn finger 3 arranged to the rear is in the inactive position, the yarn finger 3 that is arranged at the front is in the first active position, while the yarn finger 3 that is interposed between them is in the second active position or plated position. FIGS. 9 to 11 show the three positions that can be assumed by a yarn finger 3. More particularly, FIG. 9 shows a yarn finger 3 in the inactive position, FIG. 10 shows a yarn finger 3 in the second active position or plated position, and FIG. 11 shows a yarn finger 3 in the first active position.

It should be noted that, according to the requirements, the intermediate position can be provided for each yarn finger 3 or only for some of them.

Conveniently, the device for feeding yarn or yarns according to the invention comprises means 13 for detecting the rotational position at least of the yarn fingers 3 for which the possibility to be moved to the second active position is provided.

Preferably, the means 13 for detecting the rotational position of the yarn fingers 3 comprise a Hall-effect detector which is interposed between the yarn finger 3 to be controlled and the supporting structure 2.

More particularly, the Hall-effect detector comprises a magnetic element 14, constituted for example by a small magnet, which is applied to a portion of the corresponding yarn finger 3, and a corresponding linear magnetic Hall-effect sensor 15, which is arranged on an electronic control board 16 connected to the supporting structure 2.

The electric coils 9*a*, 9*b* are connected to an electronic control board 16 which supplies power to the electric coils 9*a*, 9*b* and therefore moves the yarn fingers 3 according to a knitting program which is preset in an electronic control element 17 which supervises the operation of the machine on which the device for feeding yarn or yarns according to the invention is arranged.

Figure 12:
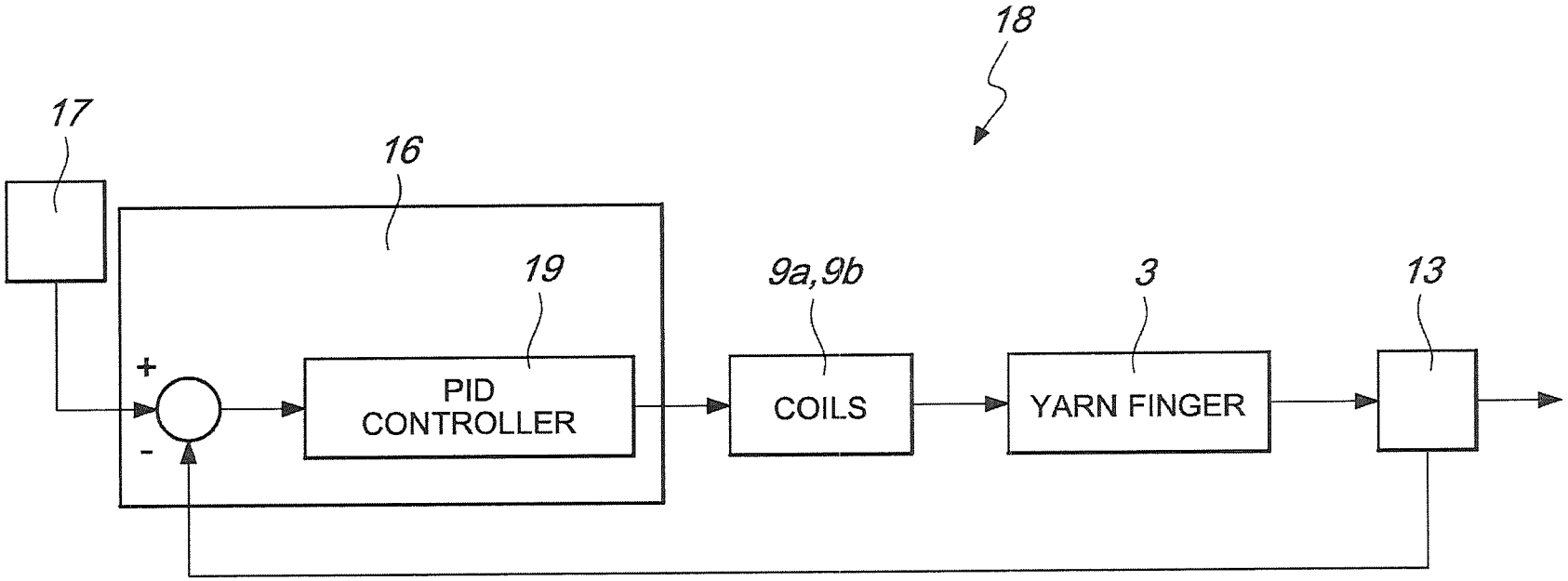
FIG. 12 is a control and monitoring diagram of the rotational position of a yarn finger about the corresponding rotation axis.

The rotational position of the yarn fingers 3 for which the second active position is provided is activated and controlled, by means of a control system in a closed-loop feedback, shown schematically in FIG. 12 and designated generally by the numeral 18, by the electronic control board 16 which is connected to the means 13 for detecting the rotational position of the yarn finger 3 and which controls the power supply of the electric coils 9*a*, 9*b* as a function of the rotational value detected by said detection means 13. Essentially, in the closed-loop feedback control system 18, the value that corresponds to the rotational position of the yarn finger 3 detected by the linear magnetic Hall-effect sensor 15 is compared with a reference value that corresponds to the desired rotational position, which can be stored by self-learning in the electronic control element 17, and the difference between these two values is used, by means of a PID controller 19, in order to supply power to the pair of electric coils 9*a*, 9*b* of the corresponding yarn finger 3 so as to vary the rotational position of said yarn finger 3.

The operation of the device for feeding yarn or yarns according to the invention is evident from what has been described and illustrated, and in particular it is evident that by means of the electric power supply of a pair of electric coils 9*a*, 9*b* it is possible to actuate individually the corresponding yarn finger 3 arranged between them, causing its transition from the inactive position to the first active position or to the second active position and vice versa as a function of the various production requirements.

In practice, the electronic control element 17 that supervises the operation of the machine supplies power, by means of the electronic control board 16, to the various pairs of electric coils 9*a*, 9*b* on the basis of preset knitting programs so as to move to the first active position or to the second active position the yarn fingers 3 that must supply yarn to the needles that are moved to knit at the feed or drop at which the device for feeding yarn or yarns is arranged.

It should be noted that due to the fact that the electric coils 9*a*, 9*b* that generate the magnetic field by means of which the individual rotation of the yarn fingers 3 is performed are associated with static components, constituted by the plates 12, of the device for feeding yarn or yarns, there are no problems of fatigue failure of the electrical wires for supplying power to the electric coils 9*a*, 9*b*. For this reason, the device for feeding yarn or yarns according to the invention has a distinctly higher reliability and durability than the devices for feeding yarn or yarns with electromagnetic actuation of the known type.

Furthermore, the particular arrangement of the shielding elements, constituted by the plates 12, and their use to support the electric coils 9*a*, 9*b* allows to avoid actuation interference between contiguous yarn fingers 3 and at the same time to contain acceptably the space occupation of the device for feeding yarn or yarns along a direction that is parallel to the rotation axis 4.

In practice it has been found that the device for feeding yarn or yarns according to the invention achieves fully the intended aim, since it retains the advantages of the devices for feeding yarn or yarns with electromagnetic actuation of the known type as regards simplicity in installation and management, precision and repeatability in operation, and moreover ensures higher durability and reliability, reducing the number of maintenance interventions required in order to maintain its functionality.

The device for feeding yarn or yarns thus conceived is susceptible of numerous modifications and variations, all of which are within the scope of the appended claims; thus, for example, for each yarn finger 3 there might be a single coil and the shape of the coils might be different from the cylindrical one shown; furthermore, all the details may be replaced with other technically equivalent elements.

In practice, the materials used, so long as they are compatible with the specific use, as well as the dimensions, may be any according to the requirements and the state of the art.

The disclosures in Italian Patent Application No. 102017000057890 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A device for feeding a yarn or yarns for knitting machines for hosiery, comprising:

a supporting structure;

a first yarn finger which has an elongated shape and is pivoted, at an intermediate portion of the first yarn finger, to the supporting structure about a corresponding rotation axis and having, proximate to a longitudinal end of the first yarn finger, a passage for the yarn or yarns to be fed to needles of a knitting forming machine;

an electromagnetically actuated device that acts on command on the first one yarn finger for rotation of the first yarn finger, with respect to the supporting structure, about the corresponding rotation axis, from an inactive position to at least one active position, which is angularly spaced with respect to the inactive position about the rotation axis, or vice versa, wherein the electromagnetically actuated device comprises at least one magnet that is fixed to the first yarn finger;

a pair of electric coils, wherein a first electric coil of the pair of electric coils is positioned to directly face a portion of the first yarn finger in a first direction, second electric coil of the pair of electric coils is positioned to directly face the portion of the first yarn finger in a second direction, and the second direction is opposite to the first direction, the pair of electric coils being connected to the supporting structure, the pair of electric coils being able to be supplied electrically to generate a magnetic field that interacts with the at least one magnet to actuate the rotation of the first yarn finger about the corresponding rotation axis with respect to the supporting structure, a second yarn finger pivoted to the supporting structure about a same rotation axis as the first yarn finger; and magnetic field shielding elements interposed between one of the pair of electric coils that act on the first yarn finger and one of another pair of electric coils that act on the second yarn finger.

2. The device according to claim 1, wherein the at least one magnet is fixed to a portion of the first yarn finger that is located on an opposite side of the passage for the yarn or yarns with respect to the rotation axis.

3. The device according to claim 1, wherein a portion of the first yarn finger that supports the at least one magnet is crossed by a seat that accommodates a corresponding magnet of the at least one magnet; the pair of electric coils being arranged so that their axes are perpendicular to two opposite faces of the portion of the corresponding yarn finger that supports the at least one magnet.

4. The device according to claim 1, wherein the pair of electric coils are coaxial.

5. The device according to claim 1, wherein the second yarn finger is laterally mutually adjacent from the first yarn finger.

6. The device according to claim 1, wherein the magnetic shielding elements are constituted by plates made of ferromagnetic material, which are arranged at right angles to the rotation axis and are connected to the supporting structure.

7. The device according to claim 6, wherein a first side of a plate that constitutes one of the shielding elements is connected to one of the pair of electric coils that acts on the first yarn finger, and a second side of the plate is connected to one of another pair of electric coils that acts on the second yarn finger.

8. The device according to claim 1, wherein each one of the pair of electric coils is constituted by at least one electrically conducting wire which is spirally wound and is applied to a face of a plate that constitutes one of the shielding elements.

9. The device according to claim 1, wherein the first yarn finger can rotate on command about the corresponding rotation axis with respect to the supporting structure from the inactive position to at least one first active position and to at least one second active position which is arranged between the inactive position and the first active position or vice versa.

10. The device according to claim 1, further comprising a sensor for detecting a rotational position of the first yarn finger about the corresponding rotation axis to said supporting structure.

11. The device according to claim 10, wherein the sensor is a Hall-effect detector interposed between the first yarn finger and the supporting structure.

12. The device according to claim 11, wherein the Hall-effect detector comprises a magnetic element applied to the first yarn finger and a corresponding linear magnetic Hall-effect sensor arranged on the supporting structure.

13. The device according to claim 1, further comprising an electronic control board which supplies electric power to the pair of electric coils according to a processing program that is preset in an electronic control element.

14. The device according to claim 10, wherein the rotational position of the first yarn finger is actuated and controlled by a closed-loop feedback control system by an electronic control board, which is connected to the sensor for detecting the rotational position of the first yarn finger and controls a power supply of the pair of electric coils between which the first yarn finger is arranged as a function of a rotational value detected by the sensor.

* * * * *